US006273094B1

(12) United States Patent
Potter

(10) Patent No.: US 6,273,094 B1
(45) Date of Patent: Aug. 14, 2001

(54) TOBACCO PRODUCT SNUFFER

(75) Inventor: Thomas Potter, Carson City, NV (US)

(73) Assignee: Retco International LLC, Carson City, NV (US)

( * ) Notice: Subject to any disclaimer, the term of this patent is extended or adjusted under 35 U.S.C. 154(b) by 0 days.

(21) Appl. No.: 09/390,557

(22) Filed: Sep. 3, 1999

(51) Int. Cl.[7] ..... A24F 13/18; A24F 19/14; A24D 1/12

(52) U.S. Cl. ..... 131/256; 131/235.1; 131/237; 131/175; D27/102; D27/136

(58) Field of Search ..... 131/256, 235.1, 131/237, 178, 175; 206/496, 246; D27/102, 108, 127, 133, 136

(56) References Cited

U.S. PATENT DOCUMENTS 2,113,745 * 4/1938 Pyatt ..... 131/235.1
4,660,575 * 4/1987 Andreason et al. ..... 131/256
5,002,073 * 3/1991 Chiang ..... 131/178

* cited by examiner

*Primary Examiner*—Stanley S. Silverman
*Assistant Examiner*—Dionne A. Walls
(74) *Attorney, Agent, or Firm*—Francis C. Hand, Esq.; Carella, Byrne, Bain, Gilfillan, Cecchi, Stewart & Olstein

(57) ABSTRACT

The snuffer is constructed of three elements, i.e. a tubular member, a sleeve which fits within the tubular member and a cap which secures the sleeve in place. The sleeve has an inside diameter to slidably receive a lighted cigarette or the like. The cap has a bore through which a cigarette is to be inserted into the sleeve and from which an end of the cigarette is able to project for ease of removal for re-use. Multiple sleeves are provided to accommodate differently sized cigarettes or tobacco products.

16 Claims, 1 Drawing Sheet

10
11
12
13
14
15
15'
16
17
17'
18
18'
19
20
21
22
23
24
25
12'

TOBACCO PRODUCT SNUFFER

This invention relates to a tobacco product snuffer. More particularly, this invention relates to a snuffer for extinguishing lighted tobacco products such as cigarettes and cigars.

Devices for extinguishing lighted tobacco products, such as cigars and cigarettes, have been known for a long period of time. In years past, when the cost of cigarettes in particular were relatively modest, if a smoker had to extinguish a partially used cigarette, the cigarette was simply discarded. As the cost of cigarettes has increased, a need has arisen for smokers to be able to extinguish and then re-use a partially used cigarette. Further, due to various laws and ordinances, the locations where cigarettes or cigars may be smoked have become limited. Accordingly, in some cases, if a cigarette has not been fully used, a need arises to be able to extinguish the cigarette for transportation to a smoke-free environment for subsequent re-use in a smoke-permitted area.

Heretofore, various types of devices have been employed as cigarette snuffers. For example, U.S. Pat. No. 5,499,634 describes a device having an elongated tubular cap with a closed end into which an elongated tubular holder is telescoped. The holder and cap fit together so that a lighted tobacco product placed in the holder is extinguished by frictional closure between the cap and the holder.

U.S. Pat. No. 5,345,953 describes a cigarette snuffer which employs a tube having an open end and a closed end. In addition, slots are provided in the side walls of the tube to permit an extinguished cigarette to be manually slid out of the snuffer. Similar types of snuffing devices are described in U.S. Pat. Nos. 5,002,073; 4,886,076 and 4,497,329 and various types of cigarette snuffer designs are known from U.S. Design Pat. Nos. 344,612; 291,126; 255,498 and 245,344.

One of the problems which arises with the previously known cigarette snuffers is that cigarettes are manufactured in different diametric sizes. Thus, while a snuffer may be suitable for one size diameter cigarette, the snuffer may not be suitable for a smaller or larger sized diameter cigarette. Further, where a snuffer may be suitable for a cigarette, the snuffer may not be suitable for a cigar of a greater diameter. Accordingly, in order to accommodate different diameter cigarettes and/or cigars, multiple snuffers would be required by a user.

Other problems which have arisen with previously known cigarettes snuffers is that, once a cigarette has been extinguished, it has been cumbersome to remove the used cigarette for re-use.

Accordingly, it is an object of the invention to provide a tobacco product snuffer which can be readily adapted to different diameter tobacco products.

It is another object of the invention to provide an aesthetically pleasing snuffing device which can be carried in a shirt or jacket pocket.

It is another object of the invention to provide a snuffing device which can quickly extinguish a lighted tobacco product and which makes the product readily available for re-use.

Briefly, the invention provides a tobacco product snuffer which is comprised of three basic pieces, namely, a tubular member having a closed end, a sleeve sidably received in the tubular member and a cap to retain the sleeve in place.

The tubular member is also provided with an open end and a tapered inner peripheral wall which extends from the open end toward the closed end and which is sized to accommodate tobacco products of different diameters.

The sleeve is one of a plurality of such sleeves which differ from each by having different inside diameters. Each sleeve has an outside diameter to be slidably received within the tubular member with a friction fit while the inside diameter is such as to slidably receive and hold a cylindrical tobacco product. The outside diameter of the sleeve is such as to fit into the tubular member in a recessed manner. That is to say, the sleeve is mounted within the tubular member close to the open end.

The cap is provided with a tubular stem which is slidably received in the open end of the tubular member in order to abut and retain the sleeve within the tubular member. The same also has a bore for passage of a lighted cylindrical tobacco product therethrough. The cap is also provided with a resilient clip extending co-extensively with the tubular member to enable the snuffer to be held in place in a shirt pocket or the like.

In order to use the snuffer, the appropriate sleeve of the set of sleeves is selected to fit the outer diameter of the tobacco product Typically, three sleeves are provided in a set, each with a slightly different inside diameter.

Once selected, the sleeve is inserted into the open end of the tubular member and comes to rest inside the tubular member in a recessed manner. The cap is then fitted into the open end of the tubular member to abut and retain the sleeve in place.

The assembled snuffer may be carried in a pocket of a shirt, a jacket, purse, or in any other suitable manner.

Should a smoker desire to extinguish a partially used cigarette in the snuffer, the cigarette is inserted lighted end first through the bore in the cap and thence through the sleeve. Typically, the sleeve fits snugly around the lighted cigarette and seals off the interior of the tubular member to prevent further burning of the cigarette. Since the lighted end of the cigarette is thus fitted into a closed space, the cigarette will become quickly extinguished.

Typically, the cigarette is fitted into the snuffer with the filter end (or unlighted end) projecting from the snuffer. Thus, the cigarette can be readily grasped and removed manually by the smoker from the snuffer at a later time for re-use.

The snuffer can be readily transported, e.g. in a pocket of a shirt, a jacket, purse or the like with the extinguished cigarette in place.

These and other objects and advantages of the invention will become more apparent from the following detailed description taken in conjunction with the accompanying drawings wherein.

Figures 1, 2, 3, 4:
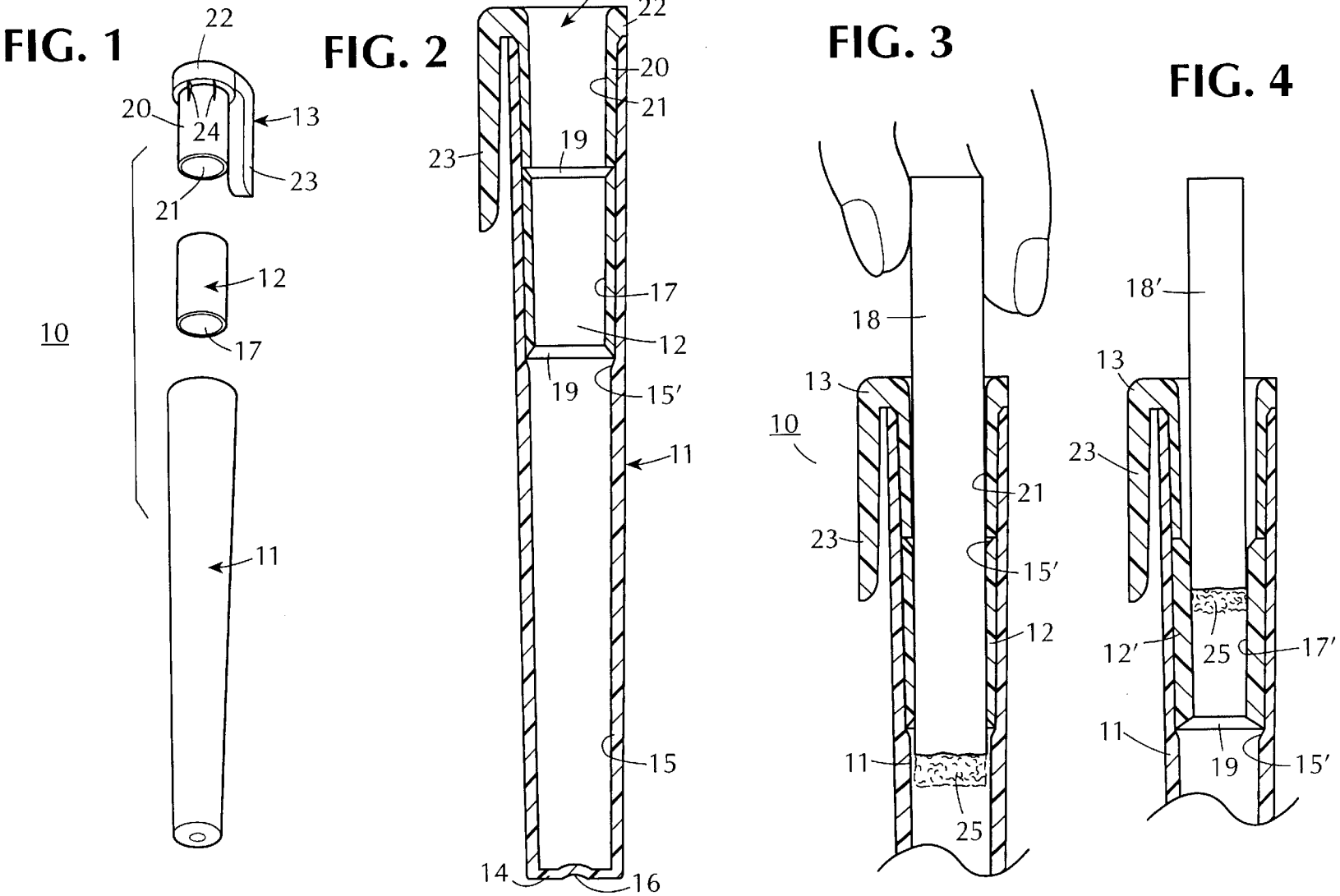
FIG. 1 illustrates an exploded view of a snuffer constructed in accordance with this invention.
FIG. 2 illustrates a cross-sectional view of the snuffer of FIG. 1 in an assembled condition.
FIG. 3 illustrates a part cross-sectional view of the snuffer of FIG. 2 with a cigarette being put into place.
FIG. 4 illustrates a cross-sectional view of a modified snuffer employing a sleeve of different diameter from that as shown in FIG. 3 in accordance with the invention.

Referring to FIG. 1, the cigarette snuffer 10 is constructed of three basic pieces, namely, a tubular member 11, a sleeve 12 and a cap 13.

Referring to FIG. 2, the tubular member 11 has an open end, a closed end 14 and a tapered inner peripheral wall 15 which extends from the open end toward the closed end 14 on an radially inwardly directed taper. That is to say, the tubular member 11 has a smaller inside diameter at the closed end 14 than at the open end.

As shown in FIG. 2, the closed end 14 of the member 11 is provided with a small dimple 16 for manufacturing purposes. In this respect, the tubular member 11 is typically made of a molded plastic material.

The sleeve 12 is of tubular shape with a constant outside diameter smaller than the inside diameter of the tubular member 11 to engage with the inner peripheral wall 15 of the tubular member 11 after passing some distance into the open end of the tubular member 11. To this end, the interior wall 15 of the tubular member 11 is provided with a small annular step or shoulder 15' to act as a stop and against which the sleeve 12 abuts.

The sleeve 12 has a smooth cylindrical bore 17 having a constant inside diameter in order to slidably receive a tobacco product, such as a cigarette 18 as indicated in FIG. 3. In addition, each end of the sleeve 12 is provided with a chamber 19 to facilitate entry of a cigarette into the bore of the sleeve. In this respect, the sleeve 12 is reversible so as to be used with either end as the entry end for the cigarette 18.

The cap 13 includes a tubular stem 20 which is slidably received in the open end of the tubular member 11 in order to abut and retain the sleeve 12 in place within the tubular member As illustrated, the stem 20 has a bore 21 for passage of a lighted cylindrical tobacco product, e.g. the cigarette 18 therethrough as illustrated in FIG. 3.

As illustrated in FIG. 1, the cap 13 has an annular collar 22 at one end which is of greater outside diameter than the inside diameter of the tubular member 11 in order to seat and abut against the open end of the tubular member 11. The collar 22 also has an elongated clip 23 which extends from the collar 22 in substantially parallel relation to the tubular member 11. The cap 13 is made of a resilient plastic material so that the clip 23 functions as a leaf spring to permit the snuffer 10 to be slid into a holder or pocket in a pen-like manner.

Referring to FIG. 1, the cap 13 also includes a plurality of ribs 24 on the exterior surface of the stem 20. Typically, these ribs 24 are spaced 90° apart so as to slidingly engage with the inner peripheral wall 15 of the tubular member 11 to thereby provide a snug fit. Typically, the ribs 24 are of constant height.

As indicated in FIGS. 3 and 4, wherein like reference characters indicate like parts as above, the snuffer 10 may be provided with differently-sized sleeves 12, 12'. For example, as indicated in FIG. 4, the sleeve 12' is provided with the same outside diameter as the sleeve 12 of FIG. 3 but with a smaller inside diameter in order to accommodate a cigarette 18' of smaller outside diameter.

In order to use the snuffer 10, the various parts of the snuffer 10 are assembled as indicated in FIG. 2. That is to say, the sleeve 12 is first inserted into the tubular member 11 and thereafter the stem 20 of the cap 13 is inserted into the open end of the tubular member 11 to push the sleeve 12 further into the tubular member 11 in a fully seated manner. Next, as indicated in FIG. 3, a lighted cigarette 18 is slid through the bore 21 of the cap 13 into the sleeve 12. In this respect, the bore 21 of the cap 13 is of a greater inside diameter than the cigarette 18 as well as the inside diameter of the sleeve 12 so that any size cigarette may be readily passed through the cap 13 into the appropriately sized sleeve 12.

Typically, the cigarette 18 is slid through the sleeve 12 so that the lighted end 25 is disposed in the space between the closed end 14 of the tubular member 11 and the sleeve 12. Due to the sliding fit between the cigarette 18 and the sleeve 12, the oxygen within the closed-off tubular member 11 is quickly consumed and the lighted end 25 of the cigarette 18 extinguished.

Further, as indicated in FIG. 3, the lighted cigarette 18 need only be slid into the snuffer 10 for a distance which allows the free end of the cigarette to project from the snuffer 10. Thus, when the user is ready to re-use the cigarette 18, the cigarette 18 can be easily pulled from the snuffer 10 for re-lighting.

By way of example, the tubular member 11 is of constant thickness with a length of approximately 3.25" and an inside diameter at the open end of 0.405". In addition, the outside wall of the tubular member 11 forms an angle of 91° relative to a horizontal plane as viewed.

The sleeve 12 of FIG. 2 is of a length of 0.73" with an outside diameter of 0.392" and an inside diameter of 0.312".

The cap 13 is of an overall length of 0.61" with a collar 22 of 0. 100" in length. Each rib 24 has a length of 0.18".

The bore 20 of the cap 13 has an inside diameter of 0.335" while the outside diameter is 0.403".

The clip 23 of the cap 13 has a length of 9/872" and a width of 1/8".

The sleeve 12 may also be provided with internal ribs (not shown) to increase the frictional contact with a received cigarette 18 while preserving the seal-type fit of the cigarette 18 relative to the sleeve 12.

In order to replace the sleeve 12 for use with a smaller sized cigarette 18', the cap 13 is slid off the end of the tubular member 11 and the tubular member 11 then inverted and tapped on a surface so that the sleeve 12 is dislodged and removed from the tubular member 11. A sleeve 12' having a smaller bore is then inserted into the tubular member 11, as indicated in FIG. 4 and the cap 13 again re-inserted into the tubular member 11 in order to abut and retain the sleeve 12' in place. A lighted cigarette 18' of a smaller diameter than cigarette 18 of FIG. 3 may then be inserted into the snuffer 10 and slid into the bore 17' of the sleeve 12' as above.

After a lighted cigarette has been inserted into the snuffer 10, the snuffer 10 may be placed in a pocket, purse, handbag or the like and carried in an extinguished condition for a subsequent re-use.

After being used, the ashes which accumulate within the tubular member 11 may be readily removed by inverting and tapping the snuffer 10 against a surface. Further, cleaning of the snuffer 10 can be accomplished by removing the cap 13 and the sleeve 12.

The snuffer 10 may be provided as a kit along with a multiple number of sleeves 12 with different sized inner diameters. For example, three sleeves may be provided, each with a different inner diameter and with each being color-coded in order to indicate different sizes for receiving different size cigarettes such as an ultra slim, slim and standard.

Typically, all the components of the snuffer 10 are made of the same plastic material.

The invention thus provides a snuffer of lightweight material which can be readily carried from place to place. Further, the invention provides a snuffer which is readily useable and transportable. In this respect, the snuffer, when assembled, is ready to receive a lighted cigarette without any further manipulation. Likewise, a received cigarette is received with an exposed end so that the cigarette may be readily grasped and removed when the cigarette is to be re-lighted and re-used.

The invention further provides a snuffer which can be readily adapted for differently sized tobacco products. For example, multiple sleeves are provided to receive cigarettes of different diameters. Further, the snuffer can be sized so as to receive a cigar or cigarillo or other similar cylindrical tobacco product. In this respect, a snuffer may be sized so as to receive a cigar as the largest size tobacco product and a cigarette as the smallest size tobacco product. Alternatively, a snuffer may be constructed to solely receive a cigar without being adaptable for receipt of differently sized cylindrical tobacco products.

What is claimed is:

1. A snuffer comprising a tubular member having an open end, a closed end and a peripheral wall extending from said open end to said closed end;

a sleeve received in said tubular member; and a cap having a tubular stem received in said open end of said tubular member to abut and retain said sleeve in place within said tubular member, said stem having a bore for passage of a lighted cylindrical tobacco product therethrough.

2. A snuffer as set forth in claim 1 wherein said peripheral wall of said tubular member has a tapered inner surface.

3. A snuffer as set forth in claim 2 wherein said tapered inner surface includes an annular step for abutment of said sleeve thereon.

4. A snuffer as set forth in claim 2 wherein said sleeve is cylindrical.

5. A snuffer as set forth in claim 4 wherein said sleeve has a chambered end to guide a cylindrical tobacco product thereinto.

6. A snuffer as set forth in claim 1 wherein said cap has an annular collar integral with said stem and abutting said open end of said tubular member.

7. A snuffer as set forth in claim 6 wherein said cap has a plurality of circumferentially spaced ribs on an external surface of said stem to slidably engage said inner peripheral wall of said tubular member.

8. A snuffer as set forth in claim 6 wherein said cap has a resilient clip extending from said collar co-extensively with said tubular member.

9. A snuffer as set forth in claim 8 wherein said cap is made of a resilient plastic.

10. A snuffer as set forth in claim 8 wherein each of said sleeve and said tubular member is made of molded plastic.

11. A tobacco product snuffer comprising a tubular member having an open end, a closed end and a tapered inner peripheral wall extending from said open end toward said closed end;

a sleeve received in said tubular member and having an inside diameter for slidably receiving and holding a cylindrical tobacco product therein; and a cap having a tubular stem slidably received in said open end of said tubular member to retain said sleeve in place within said tubular member, said stem having a bore for passage of a lighted cylindrical tobacco product therethrough.

12. A snuffer as set forth in claim 11 wherein said sleeve has a chambered end to guide a cylindrical tobacco product thereinto.

13. A snuffer as set forth in claim 11 wherein said cap has an annular collar integral with said stem and abutting said open end of said tubular member.

14. A snuffer as set forth in claim 11 wherein said cap has a plurality of circumferentially spaced ribs on an external surface of said stem to slidably engage said inner peripheral wall of said tubular member.

15. A snuffer as set forth in claim 11 wherein each of said tubular member, sleeve and cap is made of molded plastic.

16. A snuffer as set forth in claim 11 wherein said sleeve is cylindrical and has a chamfered end at each end to guide a cylindrical tobacco product therethrough.

* * * * *

UNITED STATES PATENT AND TRADEMARK OFFICE

CERTIFICATE OF CORRECTION

PATENT NO. : 6,273,094 B1
DATED : August 14, 2001
INVENTOR(S) : Thomas Potter

It is certified that error appears in the above-identified patent and that said Letters Patent is hereby corrected as shown below:

Claim 5,
Line 2, change "chambered" to -- chamfered --

Claim 12,
Line 2, change "chambered" to -- chamfered --

Signed and Sealed this

Nineteenth Day of March, 2002

*Attest:*

*Attesting Officer*

JAMES E. ROGAN
*Director of the United States Patent and Trademark Office*